US011815850B2

(12) United States Patent
Arimura et al.

(10) Patent No.: US 11,815,850 B2
(45) Date of Patent: Nov. 14, 2023

(54) IMAGE FORMING SYSTEM

(71) Applicant: Canon Kabushiki Kaisha, Tokyo (JP)

(72) Inventors: Koji Arimura, Ibaraki (JP); Naoyuki Yamamoto, Chiba (JP); Kenichiro Kitajima, Ibaraki (JP); Shuichi Tamura, Ibaraki (JP); Ryota Fujioka, Chiba (JP); Yoshiro Tsukada, Chiba (JP); Shohei Okumura, Tokyo (JP); Takahiro Suzuki, Saitama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/968,206

(22) Filed: Oct. 18, 2022

(65) Prior Publication Data

US 2023/0129927 A1 Apr. 27, 2023

(30) Foreign Application Priority Data

Oct. 22, 2021 (JP) ..... 2021-173229

(51) Int. Cl.
*G03G 15/20* (2006.01)
*G03G 8/00* (2006.01)

(52) U.S. Cl.
CPC ..... *G03G 8/00* (2013.01); *G03G 15/2032* (2013.01)

(58) Field of Classification Search
USPC ..... 399/341
See application file for complete search history.

(56) References Cited

U.S. PATENT DOCUMENTS

2005/0207807 A1* 9/2005 Tombs ..... G03G 15/2021 399/341

FOREIGN PATENT DOCUMENTS

CN 112955823 A * 6/2021 ..... G03G 15/2064
JP 2018-69669 A 5/2018

OTHER PUBLICATIONS

Co-pending U.S. Appl. No. 17/968,224, filed Oct. 18, 2022.
Co-pending U.S. Appl. No. 17/969,011, filed Oct. 19, 2022.

* cited by examiner

*Primary Examiner* — Quana Grainger
(74) *Attorney, Agent, or Firm* — Venable LLP

(57) ABSTRACT

An image forming system includes an image forming apparatus, a varnish application apparatus, and a controller. When the image forming apparatus is in a standby state and preheating of varnish in a tank by a heater is completed, if an image forming job of forming a toner image on a first recording material and applying varnish thereto by a varnish coater is received, the controller controls a guide member to guide the first recording material to a first conveyance path. When the image forming apparatus is in a standby state and preheating of varnish in the tank by the heater is not completed, if an image forming job of forming a toner image on a second recording material and not applying varnish thereto by the varnish coater is received, the controller controls the guide member to guide the second recording material to a second conveyance path.

8 Claims, 5 Drawing Sheets

IMAGE FORMING SYSTEM

BACKGROUND OF THE INVENTION

Field of the Invention

The present invention relates to an image forming system including an image forming apparatus for forming an image on a recording material and a varnish application apparatus for applying varnish to the recording material on which the image has been formed.

Description of the Related Art

There has been proposed an image forming system equipped with an image forming apparatus for forming an image on a recording material and a varnish application apparatus for applying varnish to the recording material on which the image has been formed (Japanese Patent Application Laid-Open Publication No. 2018-69669). The image forming system disclosed in Japanese Patent Application Laid-Open Publication No. 2018-69669 is a system that adopts an in-line configuration, in which a recording material on which an image has been formed is automatically conveyed from the image forming apparatus to the varnish application apparatus to thereby perform an image forming process and a varnish coating process consistently to the recording material accompanying the input of an image forming job.

Generally, a start-up time from the turning on of power to reaching of a standby state capable of performing varnish application in a varnish application apparatus is longer than a start-up time in an image forming apparatus from the turning on of power to reaching of a standby state capable of performing image forming operation. This is because in the varnish application apparatus, time is required for heating and agitating varnish stored in a varnish storage tank to realize a viscosity suitable for application, and time is also required for supplying varnish from the varnish storage tank to a varnish application unit for applying varnish to the recording material.

Hitherto, the image forming system has been designed to start both the image forming process performed by the image forming apparatus and the varnish coating process by the varnish application apparatus only after the entire image forming system has reached the standby state. In other words, the image forming system waits to perform the image forming process and the varnish coating process entered by the user until the varnish application apparatus, which requires a longer start-up time than the image forming apparatus, is in the standby state. However, the productivity offered by the image forming system is deteriorated if the image forming process by the image forming apparatus is not started unless the varnish application apparatus has reached the standby state even if only the image forming process is to be executed where an image is formed on the recording material without applying varnish thereto.

SUMMARY OF THE INVENTION

According to a first aspect of the present invention, an image forming system includes an image forming apparatus configured to form an image on a recording material, a varnish application apparatus configured to convey the recording material discharged from the image forming apparatus and apply varnish to the recording material, the varnish application apparatus including a first conveyance path through which a recording material, on which varnish is to be applied, is conveyed, a second conveyance path that differs from the first conveyance path, a guide member configured to be controlled to a first state in which a recording material is guided to the first conveyance path and to a second state in which a recording material is guided to the second conveyance path, a tank configured to store varnish, a heater configured to heat varnish in the tank, and a varnish coater configured to apply varnish in the tank to a recording material conveyed through the first conveyance path, and a controller. In a state where the image forming apparatus is in a standby state and preheating of varnish in the tank by the heater is completed, if an image forming job of forming a toner image on a first recording material and applying varnish thereto by the varnish coater is received, the controller is configured to control the guide member to the first state to guide the first recording material to the first conveyance path. In a state where the image forming apparatus is in a standby state and preheating of varnish in the tank by the heater is not completed, if an image forming job of forming a toner image on a second recording material and not applying varnish thereto by the varnish coater is received, the controller is configured to control the guide member to the second state to guide the second recording material to the second conveyance path.

Further features of the present invention will become apparent from the following description of exemplary embodiments with reference to the attached drawings.

DESCRIPTION OF THE EMBODIMENTS

Image Forming Apparatus

Figure 1:
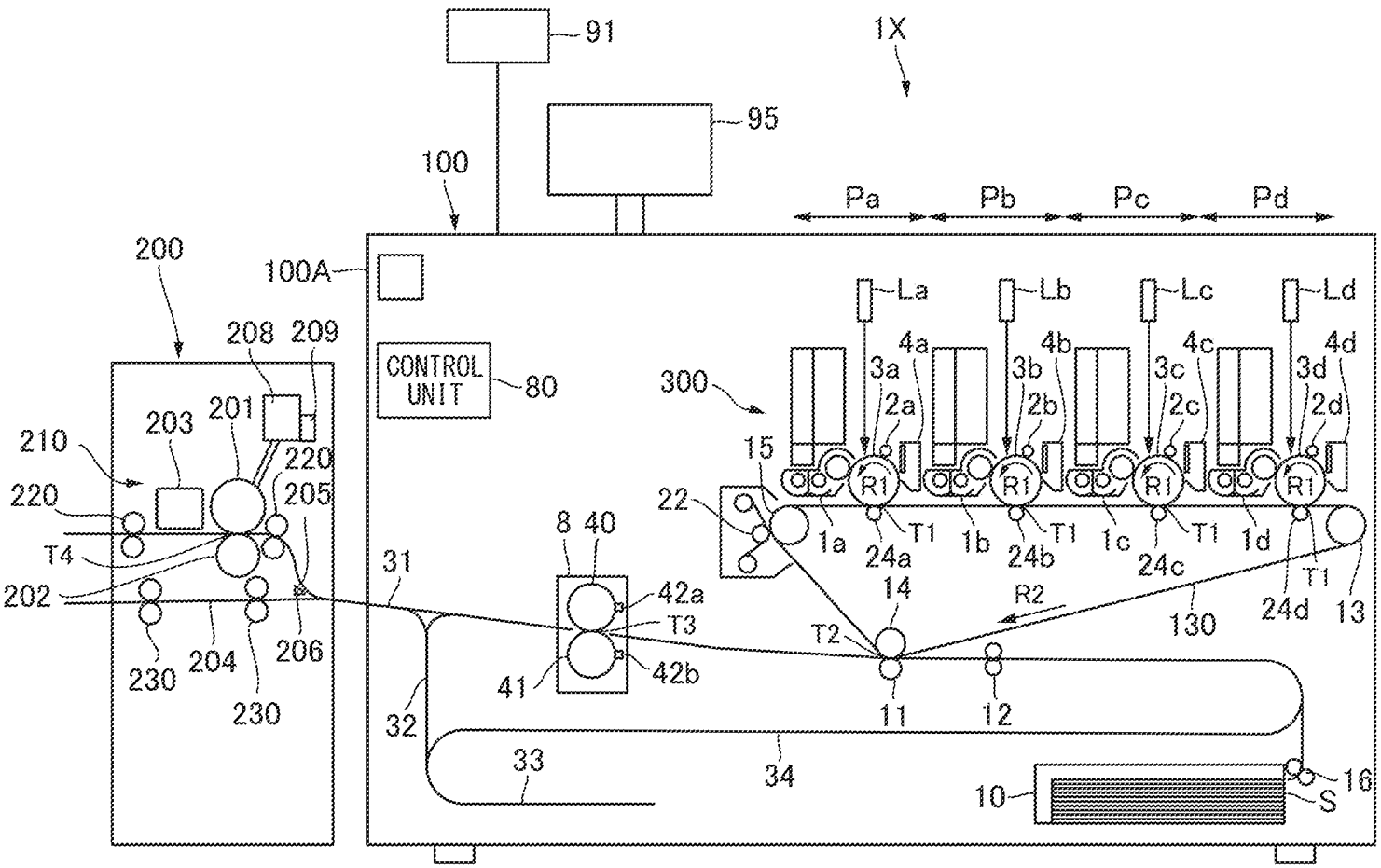
FIG. 1 is a schematic diagram illustrating an image forming system according to a present embodiment.

An image forming system according to the present embodiment will be described with reference to FIG. 1. An image forming system 1X according to the present embodiment includes an image forming apparatus 100 for forming a toner image on a recording material S and a varnish application apparatus 200 connected to the image forming apparatus 100 for applying varnish and performing surface processing to the recording material S on which the toner image has been fixed by the image forming apparatus 100. The image forming system 1X is equipped with a main power switch not shown, and by power supplied from an external power supply or an internal power supply in response to turning on of power of the main power switch, the image forming apparatus 100 and the varnish application apparatus 200 are respectively started from a stopped state.

The image forming apparatus 100 is a tandem-type full-color printer adopting an electrophotographic system. The image forming apparatus 100 includes image forming units Pa, Pb. Pc, and Pd respectively forming color images of yellow, magenta, cyan, and black. The image forming apparatus 100 forms a toner image on the recording material S based on an image signal from a document reading apparatus (not shown) connected to the apparatus body 100A or an external apparatus 91 such as a personal computer that is connected to the apparatus body 100A in a manner capable of communicating signals therewith.

According to the present embodiment, an image forming unit 300 for forming a toner image on a recording material S is composed of image forming units Pa to Pd, primary transfer rollers 24*a* to 24*d*, an intermediate transfer belt 130, a plurality of rollers 13 to 15, and a secondary transfer outer roller 11. Further, various types of sheet materials, such as paper material including plain paper, thick paper, rough paper, uneven paper, and coated paper, plastic films, and cloth, can be used as the recording material S.

As illustrated in FIG. 1, the image forming units Pa, Pb, Pc, and Pd are aligned along a direction of movement of the intermediate transfer belt 130 within the apparatus body 100A. The intermediate transfer belt 130 is stretched across the plurality of rollers (13, 14, and 15) and configured to rotate in a direction of arrow R2. The intermediate transfer belt 130 is configured to bear and convey a toner image that has been primarily transferred thereto. The secondary transfer outer roller 11 is arranged at a position opposed to a secondary transfer inner roller 14 supporting and stretching the intermediate transfer belt 130 with the intermediate transfer belt 130 interposed therebetween, and constitutes a secondary transfer portion T2 where the toner image on the intermediate transfer belt 130 is transferred to the recording material S. A fixing apparatus 8 is arranged downstream in a recording material conveyance direction of the secondary transfer portion T2.

A cassette 10 storing the recording material S is arranged in a lower part of the image forming apparatus 100. The recording material S is conveyed by a conveyance roller 16 from the cassette 10 toward a registration roller 12. Thereafter, the registration roller 12 is started to be rotated in synchronization with the toner image formed on the intermediate transfer belt 130 as described below, by which the recording material S is conveyed to the secondary transfer portion T2. Only one cassette 10 is illustrated, but a plurality of cassettes 10 capable of storing different types of recording materials S having various sizes and thicknesses can be provided, in which case the recording material S is conveyed selectively from one of the plurality of cassettes 10. Further, not only the recording material S stored in the cassette 10 but also the recording material S supported on a manual sheet feed portion (not shown) can be conveyed.

The four image forming units Pa, Pb, Pc, and Pd arranged in the image forming apparatus 100 have substantially the same configuration except for the difference in the colors being developed. In the following description, an image forming unit Pa for developing a yellow image is described as an example, and the descriptions of other image forming units Pb. Pc, and Pd are omitted.

A cylindrical photosensitive drum 3*a* serving as a photosensitive member is arranged in the image forming unit Pa. The photosensitive drum 3*a* is driven to rotate in an arrow R1 direction. A charging unit 2*a*, an exposing unit La, a developing unit 1*a*, a primary transfer roller 24*a*, and a drum cleaning device 4*a* are arranged in a circumference of the photosensitive drum 3*a*.

A process for forming a full-color image by the image forming apparatus 100 will be described as an example. At first, in a state where an image forming operation is started, a surface of the rotating photosensitive drum 3*a* is charged uniformly by the charging unit 2*a* The charging unit 2*a* is, for example, a corona charger that irradiates charged particles by corona discharge to charge the photosensitive drum 3*a* to a uniform negative dark potential. Next, the photosensitive drum 3*a* is scanned and exposed by laser light emitted from the exposing unit La corresponding to image signals. Thereby, an electrostatic latent image corresponding to image signals is formed on the photosensitive drum 3*a*. The electrostatic latent image formed on the photosensitive drum 3*a* is developed as a toner image, which is a visible image, using developer containing toner and carrier stored in the developing unit 1*a*. According to the present embodiment, the developing units 1*a* to 1*d* respectively use two-component developer containing nonmagnetic toner and magnetic carrier. Toner having a low melting point and containing binding resin, coloring agent, and wax as a releasing agent is used.

The toner image formed on the photosensitive drum 3*a* is primarily transferred to the intermediate transfer belt 130 at a primary transfer portion T1 formed between the intermediate transfer belt 130 and the primary transfer roller 24*a* arranged in a manner interposing the intermediate transfer belt 130. In this state, a primary transfer voltage is applied to the primary transfer roller 24*a* The toner remaining on the surface of the photosensitive drum 3*a* after primary transfer is removed by the drum cleaning device 4*a*.

The above-described operation is performed sequentially in each of the image forming units Pa to Pd corresponding to yellow, magenta, cyan, and black, and the toner images of four colors are superposed on the intermediate transfer belt 130. Thereafter, at a matched timing with the formation of toner images, the recording material S stored in the cassette 10 is conveyed to the secondary transfer portion T2. Then, by applying a secondary transfer voltage to the secondary transfer outer roller 11, a full-color toner image formed on the intermediate transfer belt 130 is collectively secondarily transferred to the recording material S. The toner remaining on the intermediate transfer belt 130 after secondary transfer is removed by a belt cleaning device 22.

Next, the recording material S to which the toner image has been transferred is conveyed to the fixing apparatus 8. In the fixing apparatus 8, the recording material S bearing the toner image is nipped and conveyed at a fixing nip portion T3 composed of a fixing belt 40, serving as a fixing member, and a pressing belt 41, and heat and pressure is applied to the recording material S. The toner of the toner image borne on the recording material S is melted and mixed by the heat and pressure applied in this manner, and the toner image is fixed on the recording material S as a full-color image. A series of image forming processes is completed in this manner.

Varnish Application Apparatus

The image forming system 1X according to the present embodiment includes the image forming apparatus 100 and the varnish application apparatus 200 connected thereto so as to enable an image forming process of forming a toner image on the recording material S by the image forming apparatus 100 and a varnish coating process of applying varnish by the varnish application apparatus 200 to be processed consecutively. In other words, the image forming system 1X is an in-line system capable of automatically conveying the recording material S on which the toner image has been formed from the image forming apparatus 100 to the varnish application apparatus 200 to thereby consistently perform the image forming process and the varnish coating process to the recording material S when an image forming job is entered.

The varnish application apparatus 200 is configured to be connectable to the image forming apparatus 100 as one of its peripheral devices, also referred to as optional units, that can be retrofitted to the image forming apparatus 100 to expand the functions thereof. The varnish application apparatus 200 is capable of applying varnish as surface processing to the recording material S discharged from the apparatus body 100A with the aim to apply glossiness and provide surface protection as added value to the recording material S, for example. The varnish application apparatus 200 is, for example, an apparatus having a maximum sheet passing size of 330 mm×482 mm, an applicable varnish thickness, i.e., coating thickness, of 6 to 14 μm, and a maximum conveyance speed of the recording material S of 35 m/min.

Next, the varnish application apparatus 200 will be described. An example of using an ultraviolet-curing type UV varnish, which is a varnish cured by ultraviolet radiation is described. As illustrated in FIG. 1, the varnish application apparatus 200 includes a varnish storage tank 208, serving as a tank, that stores varnish liquid or varnish, a heater 209 that heats varnish liquid stored in the varnish storage tank 208, and a varnish application unit 210 that applies varnish to the recording material S by receiving varnish supply from the varnish storage tank 208. The varnish application unit 210 is an example of a varnish coater configured to apply varnish in the varnish storage tank 208 to a recording material S conveyed through a varnish application route 205 described below. The varnish application unit 210 includes a varnish application roller 201 and a counter roller 202 serving as an application unit for forming a varnish application nip portion T4 for applying varnish on the recording material S, and an ultraviolet radiation lamp 203 serving as an irradiation unit for curing varnish applied to the recording material S. Further, although not shown, the varnish application unit 210 includes a pressurization mechanism that urges the varnish application roller 201 and the counter roller 202 toward each other, and a supplying mechanism that supplies varnish from the varnish storage tank 208 serving as a storage container to the varnish application roller 201.

The varnish application roller 201 is formed to have a dimension capable of applying varnish supplied from the varnish storage tank 208 across the entire area of the recording material S in a longitudinal width direction that is orthogonal to the conveyance direction. The ultraviolet radiation lamp 203 irradiates the recording material S on which varnish is applied by the varnish application roller 201 with UV light having a wavelength corresponding to varnish, to thereby cure the varnish. The ultraviolet radiation lamp 203 is disposed to irradiate ultraviolet radiation. i.e., UV light, to approximately the entire area of the recording material S in the longitudinal width direction, similar to the varnish application roller 201.

Further, the varnish application apparatus 200 includes a first conveyance unit 220 and a second conveyance unit 225 for conveying the recording material S. The interior of the varnish application apparatus 200 is divided into a varnish application route 205 (a first conveyance path) through which the recording material S is conveyed through the varnish application unit 210, and a varnish bypath route 204 (a second conveyance path) through which the recording material S is conveyed without passing through the varnish application unit 210. A switching unit 206 is provided to switch the conveyance path of the recording material S between the varnish application route 205 and the varnish bypath route 204. The switching unit 206 is an example of a guide member, and it is controlled to a first state in which the recording material S is guided to the varnish application route 205 and a second state in which the recording material S is guided to the varnish bypath route 204. That is, the switching unit 206 is configured to be swingable, and the position of the switching unit 206 is controlled, or swung, to the first state to convey the recording material S to the varnish application route 205 and controlled, or swung, to the second state to convey the recording material S to the varnish bypath route 204. In a case where the path is switched to the varnish application route 205 by the switching unit 206, the recording material S is conveyed to the varnish application unit 210 by the first conveyance unit 220, such that varnish is applied to the recording material S before the recording material S is discharged. Meanwhile, in a case where the path is switched to the varnish bypath route 204 by the switching unit 206, the recording material S will not be conveyed to the varnish application unit 210 by the second conveyance unit 225, such that the recording material S will be discharged without having varnish applied thereto.

The application unit for applying varnish to the recording material S is not limited to the use of a roller method using the varnish application roller 201 and the counter roller 202, and the use of an inkjet method using line heads is also possible. When using line heads, the varnish is not only applied to the entire surface of the recording material S but also used to form a varnish image such as characters and figures on an arbitrary position on the recording material S. Further, a UV-curing type varnish is illustrated as an example of varnish, bit other types of varnish such as oil varnish and aqueous varnish can also be used. However, when oil varnish or aqueous varnish is used, infrared (IR) lamp is preferably used as a drying unit for drying the varnish, instead of using the ultraviolet radiation lamp 203. Further, varnish can be dried by hot air, or varnish can be dried using both the IR lamp and hot air.

Now, we will describe a start-up time that is required from the turning on of the main power switch of the image forming system 1X to the varnish application apparatus 200 reaching a standby state in which varnish application is enabled. In the present specification, a standby state of the varnish application apparatus 200 refers to a state in which the varnish application apparatus 200 is standing by in a state capable of performing varnish application immediately to the recording material S conveyed from the image forming apparatus 100. In other words, a standby state is a state in which varnish application can be started without requiring a start-up time described below in response to the entry of the image forming job. If the varnish application apparatus 200 is in the standby state, varnish application to the recording material S to which toner image has been formed by the image forming apparatus 100 can be performed successively without any waiting time after forming the toner image by the image forming apparatus 100.

Various products are purchasable as the varnish application apparatus 200, and in a case where the varnish application apparatus 200 is of a type where the UV varnish described above is cured using the ultraviolet radiation lamp 203, a start-up time of approximately 20 minutes is required for the apparatus to reach the standby state. This is due to the fact that approximately 20 minutes is required in the varnish application unit 210 to heat the varnish liquid stored in the varnish storage tank 208 by the heater 209 serving as a heating unit while agitating the same to adjust the viscosity of varnish to be suitable for application. Further, approximately five minutes is required for the ultraviolet radiation lamp 203 to be able to irradiate a light amount capable of curing varnish. Therefore, according to the present embodiment, it is assumed that the varnish application apparatus 200 is in a standby state where a predetermined time, such as 20 minutes, or longer has elapsed from the start of heating of varnish liquid by the heater 209.

Meanwhile, a start-up time of a general electrophotographic image forming apparatus 100 to reach a standby state capable of forming images from the turning on of the main power is between a few seconds to approximately seven minutes. This is due to the fact that the heating of the fixing roller 40 by a heater (not shown) to a target fixing temperature requires a few seconds to approximately seven minutes. Further, density control of toner image using a testing patch image requires a few seconds to approximately two minutes. The standby state of the image forming apparatus 100 is a state in which the apparatus 100 is waiting for an input of an image forming job in a state where a series of image forming operations to the recording material S described above is enabled to be performed after the main power has been turned on. In the case of the present embodiment, it is determined that the image forming apparatus 100 is in a standby state in a state where the fixing roller 40 is heated to a fixing temperature or higher, that is, predetermined temperature or higher, which may be 140 to 190° C., for example.

Control Unit

As illustrated in FIG. 1, the image forming apparatus 100 includes a control unit 80, which is an example of a controller. The control unit 80 will be described based on FIG. 2 with reference to FIG. 1. Various devices such as motors and power supplies for operating the image forming apparatus 100 are connected to the control unit 80 other than those illustrated in the drawings, but since they are not the main object of the present technique, they are not shown and descriptions thereof are omitted.

The control unit 80 performs various controls such as the image forming operation of the image forming apparatus 100. The control unit 80 includes a Central Processing Unit (CPU) 81, a Random Access Memory (RAM) 82, and a Read Only Memory (ROM) 83. The ROM 83 stores various programs and various data, such as an image forming job or a system control processing (refer to FIG. 3). The CPU 81 is capable of executing various programs stored in the ROM 83 and controlling each of the image forming apparatus 100 and the varnish application apparatus 200 as the image forming system 1X. The RAM 82 stores operation data and input data. The RAM 82 can also temporarily store computation processing results accompanying the execution of various programs.

The CPU 81 has, in addition to the RAM 82 and the ROM 83, an input/output interface unit (I/F unit) 85, a varnish application apparatus control unit 86, an input reception unit 87, a temperature detection unit 88, and a motor control unit 90 connected thereto via a bus 84. An operation unit 95 is connected to the input/output interface unit (I/F unit) 85. The operation unit 95 includes an input unit 93 and a display unit 94, wherein the input unit 93 is an operation panel and the like through which instructions to execute various programs such as the image forming job or input of various data by the user are received. The display unit 94 serving as an example of a display unit is, for example, a liquid crystal monitor on which various screens including a varnish coater stop screen (refer to FIG. 5 described below) and a menu screen presenting various executable programs can be displayed.

According to the present embodiment, the user can enter through the input unit 93 an instruction to start a first image forming job in which varnish application is performed after image formation and a second image forming job in which varnish application is not performed after image formation, together with information on whether to perform color printing or monochrome printing and the type of the recording material S to be used. Further, the user can enter an instruction to stop the heater 209 through the input unit 93. It is possible to display a virtual operator that resembles switches of the operation unit 95 on the display unit 94, and to enable the user to enter execution operations of various programs and input operations of various data through use of the virtual operator In other words, the operation unit 95 can be a so-called touch panel. Further, the operation unit 95 can also serve as a display unit of the external apparatus 91, such as a personal computer connected via a wired or wireless communication network.

The CPU 81 can acquire image data and various data from the external apparatus 91 such as a personal computer via the input reception unit 87. Further, according to the present embodiment, an instruction to start the first image forming job in which varnish application is performed after image formation and the second image forming job in which varnish application is not performed after image formation can be acquired from the external apparatus 91.

The temperature detection unit 88 detects the temperatures of the fixing roller 40 and the pressing roller 41 based on detection results of thermistors 42*a* and 42*b*. The CPU 81 controls a heater control unit 89 based on a temperature detected by the temperature detection unit 88. The heater control unit 89 controls a heater 40*a* for heating the fixing roller 40 and a heater 41*a* for heating the pressing roller 41 such that the temperatures of the fixing roller 40 and the pressing roller 41 become the target temperatures. According to the present embodiment, the CPU 81 can control the heater 40*a* by the heater control unit 89 such that the surface temperature of the fixing roller 40 is set to a desirable temperature within the range of 140 to 190° C., for example, as a target temperature capable of fixing the toner image to the recording material S. The target temperature of the fixing roller 40 is set to a predetermined temperature according to a grammage of the recording material S to realize both fixity of toner to the recording material S and glossiness of the toner image after fixing. Meanwhile, the CPU 81 can control the heater 41*a* by the heater control unit 89 such that the surface temperature of the pressing roller 41 is maintained to 100° C., for example.

The motor control unit 90 controls the rotation of a motor 92. The CPU 81 controls a rotational speed of the fixing roller 40 via the motor control unit 90 to thereby control a conveyance speed of the recording material S at the fixing apparatus 8 during fixing of toner image.

The varnish application apparatus control unit 86 controls the varnish application apparatus 200 connected to the image forming apparatus 100. For example, the varnish application apparatus control unit 86 controls the varnish application unit 210, the first conveyance unit 220, and the second conveyance unit 230. The CPU 81 controls the varnish application apparatus 200 by transmitting and receiving electric signals via the bus 84. Therefore, if transmission and reception of electric signals via the bus 84 between the image forming apparatus 100 and the varnish application apparatus 200 is not possible, the CPU 81 determines that the image forming apparatus 100 and the varnish application apparatus 200 are not connected.

System Control Processing

Figure 2:
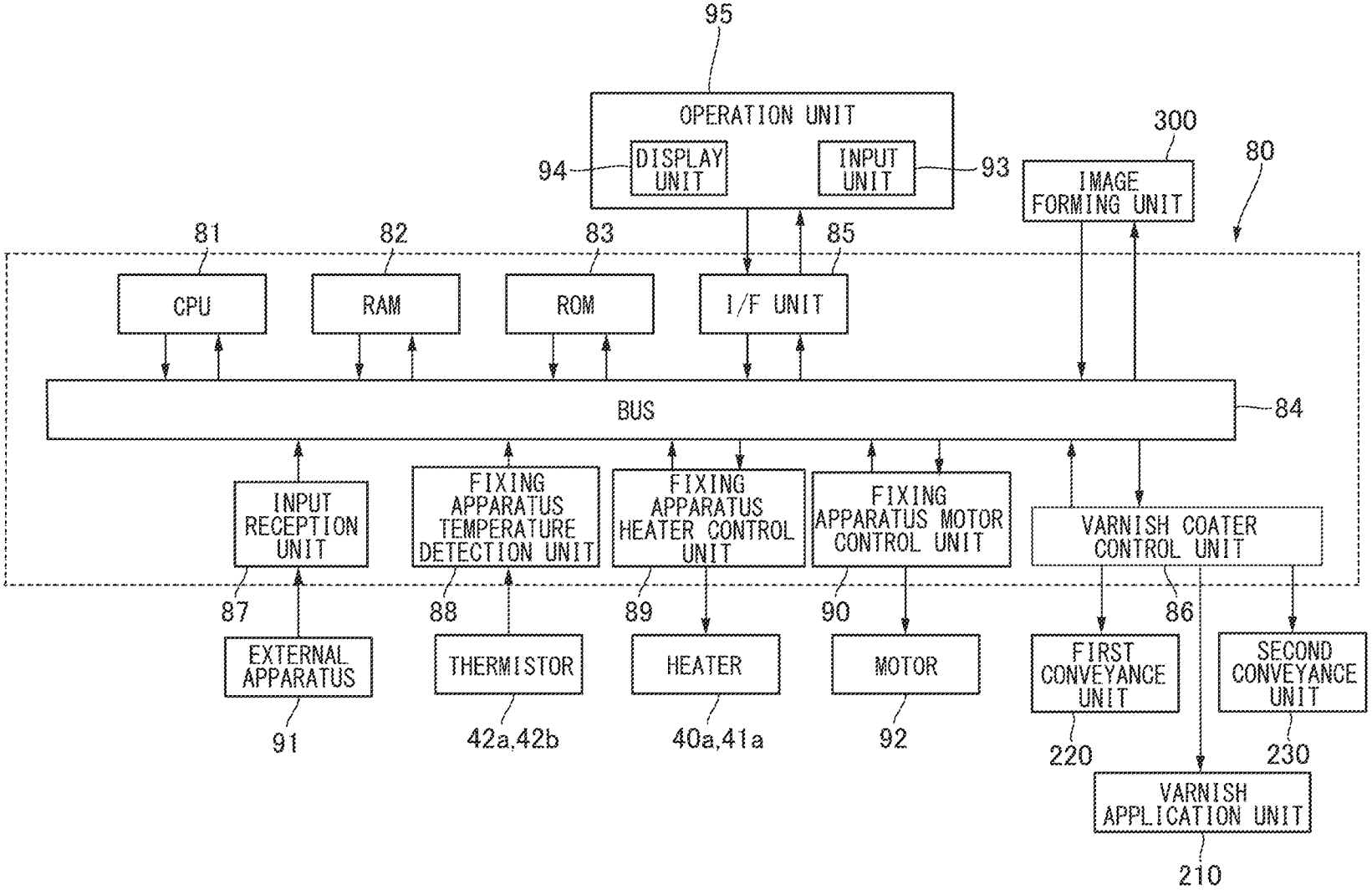
FIG. 2 is a control block diagram illustrating a control unit.

Next, the system control processing according to the present embodiment will be described based on FIG. 3 with reference to FIGS. 1 and 2. The system control processing illustrated here is started by the control unit 80 in response to the turning on of the main power of the image forming system 1X.

Figure 3:
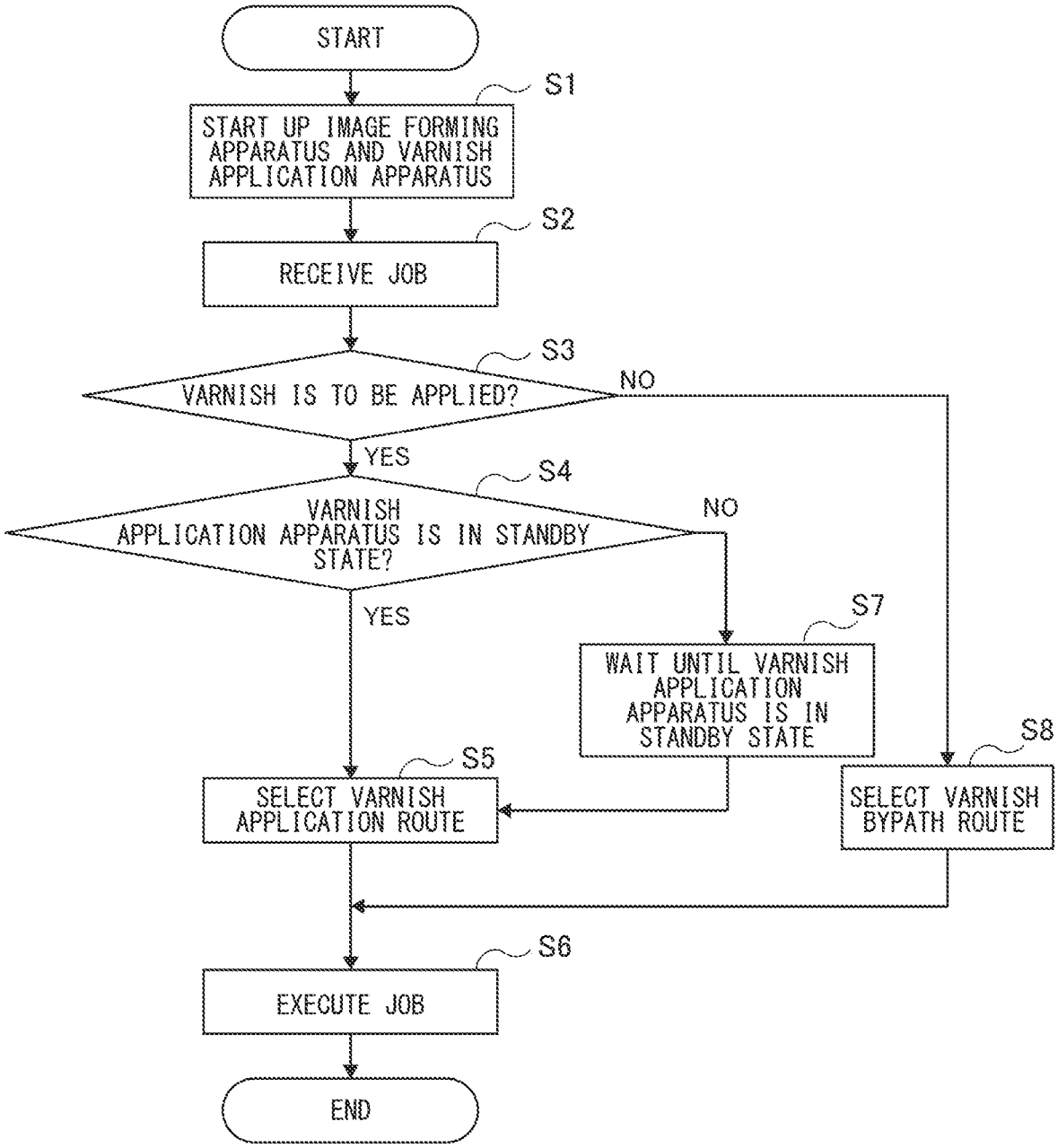
FIG. 3 is a flowchart illustrating a system control processing.

As illustrated in FIG. 3, the control unit 80 performs start-up operation of the image forming apparatus 100 and also performs start-up operation of the varnish application apparatus 200 based on the supply of power accompanying the turning on of the main power (S1). As the start-up operation, the image forming apparatus 100 performs, for example, heating of the fixing roller 40 and the pressing roller 41, adjustment of density and color shift of the toner images based on the formation of patch images for testing, and adjustment of high-pressure output such as a transfer voltage. In the varnish application apparatus 200, heating of varnish liquid within the varnish storage tank 208, supplying of power to the ultraviolet radiation lamp 203, and operations of the varnish application roller 201, the first conveyance unit 220, and the second conveyance unit 230 are performed. As described above, approximately 20 minutes is required for the varnish application apparatus 200 to reach the standby state.

The control unit 80 waits to perform the start-up operation of the image forming apparatus 100 and the varnish application apparatus 200 described above until an image forming job is received from the operation unit 95 or the external apparatus 91 (S2). When the image forming apparatus 100 is in the standby state, image forming jobs can be received from the operation unit 95 and the external apparatus 91. When an image forming job is received, the control unit 80 determines whether the image forming job is a first image forming job in which varnish application is performed after forming the image (S3).

If the job is a first image forming job (S3: Yes), the control unit 80 determines whether the start-up operation of the varnish application apparatus 200 has ended and the varnish application apparatus 200 is in a standby state (S4). In the specification, the standby state of the varnish application apparatus 200 refers to a state in which preheating of varnish in the varnish storage tank 208 by the heater 209 has been completed, for example (the same applies below). Further, the control unit 80 determines that preheating has been completed in a state where a predetermined time has elapsed after the heater 209 has started heating. If the varnish application apparatus 200 is already in the standby state (S4: Yes), the control unit 80 operates the switching unit 206 such that the recording material S passes through the varnish application route 205 (S5), and executes the first image forming job (S6). That is, if the control unit 80 receives an image forming job of forming a toner image on a first recording material S and applying varnish thereto by the varnish application unit 210 in a state where the image forming apparatus 100 is in a standby state and the varnish within the varnish storage tank 208 is in a state where preheating by the heater 209 has been completed, the control unit 80 controls the switching unit 206 to a first state so as to guide the first recording material S to the varnish application route 205.

Meanwhile, if the varnish application apparatus 200 is not yet in the standby state (S4: No), the control unit 80 waits to perform the processing until the varnish application apparatus 200 reaches the standby state, that is, after a predetermined time, such as 20 minutes, has elapsed from the turning on of the main power (S7). If a predetermined time has elapsed from the turning on of the main power and the varnish application apparatus 200 is in the standby state, the control unit 80 operates the switching unit 206 such that the recording material S passes through the varnish application route 205 (S5) and executes the first image forming job (S6). That is, if the control unit 80 receives an image forming job of forming a toner image on a first recording material S and applying varnish by the varnish application unit 210 in a state where the image forming apparatus 100 is in a standby state and the preheating of varnish in the varnish storage tank 208 by the heater 209 is not completed, the control unit 80 controls the varnish application apparatus 200 so that varnish is not applied to the first recording material S until the preheating has been completed.

As described, in a state where the control unit 80 performs varnish application to the recording material S, if the varnish application apparatus 200 is in a standby state, the first image forming job is executed immediately. At a matched timing with the starting of the first image forming job, the recording material S is conveyed from the cassette 10 by the conveyance roller 16 and image is formed in the image forming apparatus 100. The recording material S on which image has been formed is conveyed successively after image formation from the image forming apparatus 100 to the varnish application apparatus 200. Meanwhile, if the varnish application apparatus 200 is not in the standby state, the first image forming job will not be executed until the varnish application apparatus 200 is in the standby state. This is because if the varnish application apparatus 200 is not in the standby state, varnish application will not be appropriately performed to the recording material S even if the recording material S is conveyed from the image forming apparatus 100.

Meanwhile, in a case where the job is a second image forming job in which varnish is not applied after image formation (S3: No), the control unit 80 operates the switching unit 206 such that the recording material S passes through the varnish bypath route 204 (S8) and executes the second image forming job (S6). As described above, it takes approximately 20 minutes for the varnish application unit 210 to reach the standby state where varnish application is enabled. On the other hand, the first conveyance unit 220 and the second conveyance unit 230 that convey the recording material S reaches a state capable of conveying the recording material S in approximately several tens of seconds. If varnish application is not to be performed to the recording material S, the varnish application unit 210 that requires time to reach the standby state will not have to be used, so the recording material S is conveyed through the varnish bypath route 204 by the second conveyance unit 230. That is, if the control unit 80 receives an image forming job of forming a toner image on a second recording material S without applying varnish thereto by the varnish application unit 210 in a state where the image forming apparatus 100 is in a standby state and preheating of varnish in the varnish storage tank 208 by the heater 209 is not completed, the control unit 80 controls the switching unit 206 to a second state so that the second recording material S is guided to the varnish bypath route 204. If the control unit 80 receives an image forming job of forming a toner image on a second recording material S without applying varnish thereto by the varnish application unit 210 in a state where the image forming apparatus 100 is in a standby state and preheating of varnish within the varnish storage tank 208 by the heater 209 is not completed, the control unit 80 stops the first conveyance unit 220. However, the present technique is not limited thereto, and the first conveyance unit 220 is not necessarily stopped.

Hitherto, as an example, if a first or second image forming job was performed in which one sheet of recording material S that is an A4-size lateral coated paper with a grammage of 128 g/m$^2$, it took 1220 to 1230 seconds for the recording material S to be discharged from the varnish application apparatus 200. That is, it took 1200 seconds for the image forming apparatus 100 and the varnish application apparatus 200 to reach the standby state from the turning on of the main power, and hitherto, the apparatus had waited for the varnish application apparatus 200 to reach the standby state, which took longer than the image forming apparatus 100 to reach the standby state. On the other hand, according to the present embodiment, the second image forming job in which the varnish application unit 210 is not used, that is, in which varnish application is not performed, the job is executed even if the varnish application apparatus 200 is not in the standby state. In other words, the second image forming job is executed without waiting 1200 seconds for the image forming apparatus 100 and the varnish application apparatus 200 to reach the standby state, and the recording material S is discharged from the varnish application apparatus 200 approximately 45 to 450 seconds from the turning on of the main power. The time required for the image forming apparatus 100 to reach the standby state is approximately 30 to 420 seconds, depending on the type of apparatus.

As described, according to the present embodiment, if the job is a second image forming job in which varnish application is not performed, the second image forming job is executed if the image forming apparatus 100 is in the standby state even if the varnish application apparatus 200 is not in the standby state. Therefore, if the job is a second image forming job, the recording material S conveyed from the image forming apparatus 100 is conveyed using the second conveyance unit 230 in the varnish application apparatus 200. That is, the recording material S is conveyed via the varnish bypath route 204 by the second conveyance unit 230, and it is not passed through the varnish application unit 210 that requires more time to reach the standby state than the image forming apparatus 100. By conveying the recording material S using the second conveyance unit 230 in this manner, the user can start the image forming process using the image forming apparatus 100 even if the varnish application apparatus 200 is not in the standby state, and deterioration of productivity of the image forming system 1X can be suppressed.

Other Embodiments

In the embodiment described above, the second image forming job is executed even if the varnish application apparatus 200 is not in the standby state. In this state, the start-up operation of the varnish application apparatus 200 is continued, such that the varnish application apparatus 200 will eventually reach the standby state. However, if the user does not instruct varnish application to the recording material S even thereafter, that is, if only the second image forming job is executed, power will be consumed wastefully if the varnish application apparatus 200 is maintained in the standby state. It may also promote deterioration of the varnish application roller 201 and the ultraviolet radiation lamp 203.

Therefore, according to the present embodiment, if only the second image forming job is executed, the user can enter a stop instruction to stop the start-up operation of the varnish application apparatus 200 in midway such that the varnish application apparatus 200 is set to the stopped state and not in the standby state. Hereafter, a varnish coater stop processing for realizing this operation will be described based on FIGS. 4 and 5 with reference to FIGS. 1 and 2.

Figure 4:
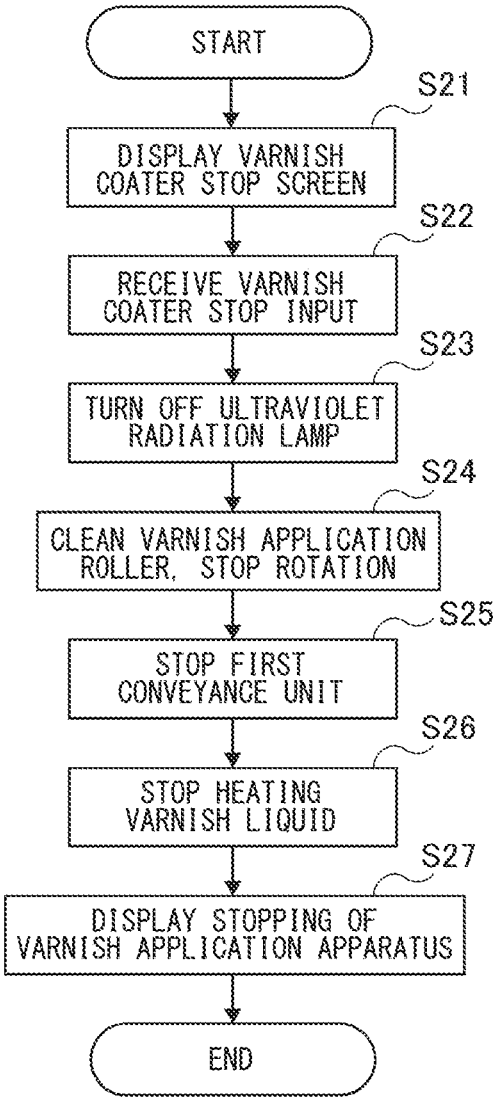
FIG. 4 is a flowchart illustrating a varnish coater stop processing.

As illustrated in FIG. 4, the control unit 80 displays a varnish coater stop screen (refer to FIG. 5) on the display unit 94 (S21). The control unit 80 receives a varnish coater stop input by the user from the varnish coater stop screen (S22). When the varnish coater stop input mentioned above is received, the control unit 80 stops the start-up operation of the varnish application apparatus 200 in midway, and sets the varnish application apparatus 200 to be in the stopped state instead of the standby state (S23 to S26). The control unit 80 turns off the ultraviolet radiation lamp 203 off, for example, in order to set the varnish application apparatus 200 to the stopped state (S23). After cleaning the varnish application roller 201, the rotation of the varnish application roller 201 is stopped (S24). The first conveyance unit 220 is stopped (S25). Further, the heating of the varnish liquid within the varnish storage tank 208 by the heater 209 is stopped (S26). That is, the control unit 80 stops the preheating performed by the heater 209 based on the stop instruction. Then, the control unit 80 displays on the varnish coater stop screen that the varnish application apparatus 200 is being stopped (S27). That is, the control unit 80 displays on the display unit 94 that the preheating is in the stopped state when the preheating by the heater 209 is stopped based on the stop instruction.

Figure 5:
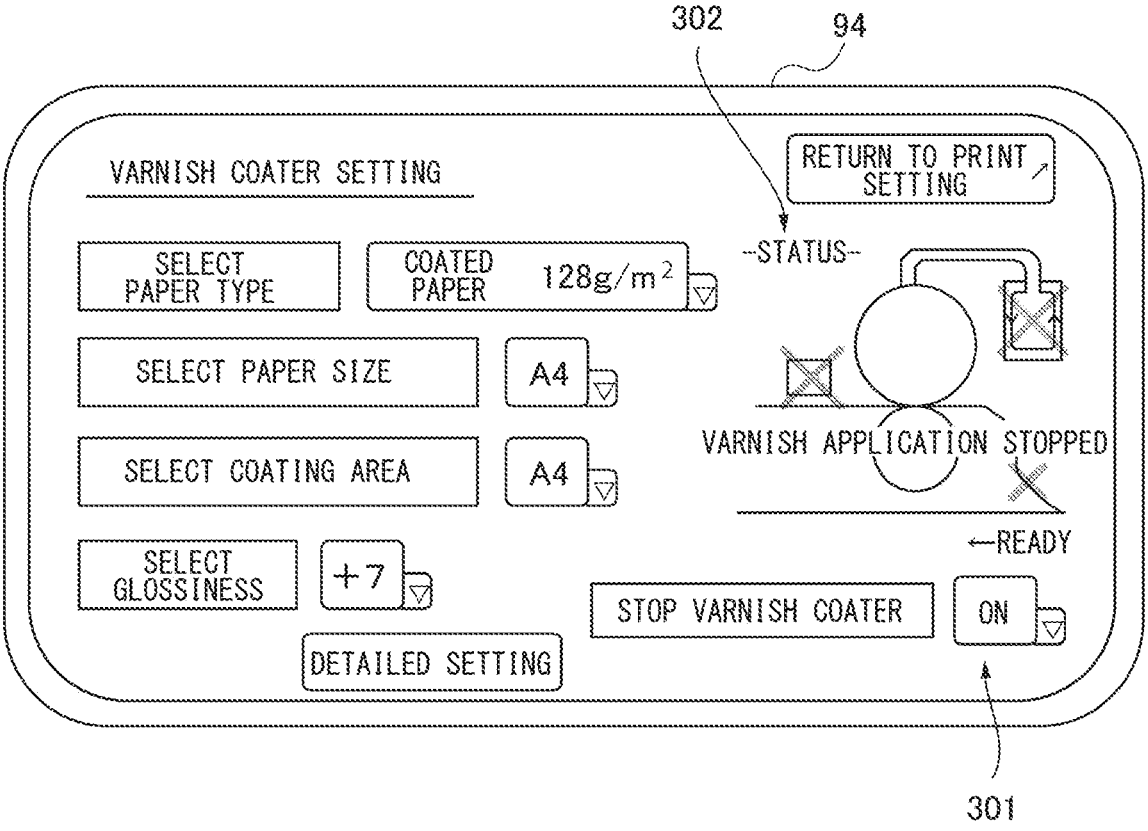
FIG. 5 is a view illustrating one example of a varnish coater stop screen.

FIG. 5 illustrates the varnish coater stop screen. As illustrated in FIG. 5, a varnish coater stop button 301 is displayed on the varnish coater stop screen as a virtual operator, i.e., software switch, allowing the user to enter a stop instruction to stop the start-up operation of the varnish application apparatus 200 in midway. When the user operates the varnish coater stop button 301, the control unit 80 receives the varnish coater stop input. Then, when the varnish application apparatus 200 is in the stopped state instead of the standby state, an information that the varnish application apparatus 200 is in a stopped state where varnish application cannot be performed is displayed on the varnish coater stop screen as a status display 302 displaying that varnish application is stopped. However, it is displayed on the status display 302 that the second conveyance unit 230 is being operated, i.e., ready display. By looking at the status display 302, the user can recognize that the second image forming job where varnish application is not performed can be carried out while the first image forming job where varnish application is performed cannot be carried out.

As described, according to the present embodiment, even in a state where the varnish application apparatus 200 is not in the standby state, if the second image forming job where varnish application is not performed is to be executed, the user can enter the stop instruction in a state where the start-up operation of the varnish application apparatus 200 is stopped in midway. When the stop instruction is entered, the start-up operation of the varnish application apparatus 200, which is continued when executing the second image job even if the varnish application apparatus 200 is not in a standby state, is stopped. According to this operation, the user can only execute the second image forming job where varnish application is not performed to the recording material S, even without setting the varnish application apparatus 200 to the standby state. In this case, since the varnish application apparatus 200 is not in the standby state, electric power will not be consumed wastefully, and the deterioration of the varnish application roller 201 and the ultraviolet radiation lamp 203 can be suppressed.

The embodiment described above is not only applied to electrophotographic image forming apparatuses in which toner images are formed using two-component developer containing toner and carrier to the recording material, and can also be applied to other types of image forming apparatuses. For example, it can be applied to inkjet-type image forming apparatuses in which images are formed by discharging ink to the recording material.

According to the present invention, deterioration of productivity of the image forming system including the image forming apparatus and the varnish application apparatus can be suppressed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2021-173229, filed Oct. 22, 2021, which is hereby incorporated by reference herein in its entirety.

What is claimed is:

1. An image forming system comprising:

an image forming apparatus configured to form an image on a recording material;

a varnish application apparatus configured to convey the recording material discharged from the image forming apparatus and apply varnish to the recording material, the varnish application apparatus comprising:

a first conveyance path through which a recording material, on which varnish is to be applied, is conveyed, a second conveyance path that differs from the first conveyance path, a guide member configured to be controlled to a first state in which a recording material is guided to the first conveyance path and to a second state in which a recording material is guided to the second conveyance path, a tank configured to store varnish, a heater configured to heat varnish in the tank, and a varnish coater configured to apply varnish in the tank to a recording material conveyed through the first conveyance path; and a controller, wherein in a state where the image forming apparatus is in a standby state and preheating of varnish in the tank by the heater is completed, if an image forming job of forming a toner image on a first recording material and applying varnish thereto by the varnish coater is received, the controller is configured to control the guide member to the first state to guide the first recording material to the first conveyance path, and wherein in a state where the image forming apparatus is in a standby state and preheating of varnish in the tank by the heater is not completed, if an image forming job of forming a toner image on a second recording material and not applying varnish thereto by the varnish coater is received, the controller is configured to control the guide member to the second state to guide the second recording material to the second conveyance path.

2. The image forming system according to claim 1, wherein in a state where the image forming apparatus is in a standby state and preheating of varnish in the tank by the heater is not completed, if the image forming job of forming a toner image on the first recording material and applying varnish thereto by the varnish coater is received, the controller is configured to control the varnish application apparatus such that varnish is not applied to the first recording material until the preheating is completed.

3. The image forming system according to claim 1, wherein the varnish application apparatus includes a first conveyance unit configured to convey a recording material in the first conveyance path and a second conveyance unit configured to convey a recording material in the second conveyance path, and wherein in a state where the image forming apparatus is in a standby state and preheating of varnish in the tank by the heater is not completed, if an image forming job of forming a toner image on the second recording material and not applying varnish thereto by the varnish coater is received, the controller is configured to set the first conveyance unit to a stopped state.

4. The image forming system according to claim 1, further comprising an input unit through which a stop instruction of the heater is entered, wherein the controller is configured to set the preheating to a stopped state based on the stop instruction.

5. The image forming system according to claim 4, further comprising a display unit, wherein if the preheating is set to the stopped state according to the stop instruction, the controller is configured to display that the preheating is in the stopped state on the display unit.

6. The image forming system according to claim 1, wherein an image formed on a recording material by the image forming apparatus is a toner image, wherein the image forming apparatus comprises:

an image forming unit configured to form a toner image on a recording material, and a fixing member configured to fix the toner image by applying heat and pressure to the recording material, and wherein in a state where a temperature of the fixing member is a predetermined temperature or higher, the controller is configured to set the image forming apparatus to a standby state.

7. The image forming system according to claim 1, wherein the varnish is an ultraviolet-curing type varnish, and wherein the varnish application apparatus further comprises an irradiation unit configured to irradiate ultraviolet radiation to varnish applied to the recording material.

8. The image forming system according to claim 1, wherein in a state where a predetermined time has elapsed from starting of heating by the heater, the controller is configured to determine that the preheating is completed.

* * * * *